US009692131B2

(12) United States Patent
Huang et al.

(10) Patent No.: US 9,692,131 B2
(45) Date of Patent: Jun. 27, 2017

(54) ANTENNA AND THE MANUFACTURING METHOD THEREOF

(71) Applicant: ARCADYAN TECHNOLOGY CORPORATION, Hsinchu (TW)

(72) Inventors: Chih-Yung Huang, Hsinchu (TW); Kuo-Chang Lo, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 72 days.

(21) Appl. No.: 14/704,268

(22) Filed: May 5, 2015

(65) Prior Publication Data

US 2016/0049732 A1 Feb. 18, 2016

(30) Foreign Application Priority Data

Aug. 12, 2014 (TW) ..... 103127685 A

(51) Int. Cl.
*H01Q 1/24* (2006.01)
*H01Q 9/04* (2006.01)
(Continued)

(52) U.S. Cl.
CPC ..... *H01Q 9/0407* (2013.01); *H01Q 1/243* (2013.01); *H01Q 1/48* (2013.01); *H01Q 5/371* (2015.01); *H01Q 5/378* (2015.01); *H01Q 9/42* (2013.01)

(58) Field of Classification Search
CPC ..... H01Q 1/243; H01Q 1/48; H01Q 5/371; H01Q 5/378; H01Q 9/0407; H01Q 9/42
(Continued)

(56) References Cited

U.S. PATENT DOCUMENTS 6,023,243 A * 2/2000 Frank ..... H01Q 21/0006 343/700 MS
6,842,158 B2 * 1/2005 Jo ..... H01Q 1/243 343/700 MS
(Continued)

FOREIGN PATENT DOCUMENTS

EP 1679762 A1 7/2006
EP 2704257 A1 3/2014
(Continued)

OTHER PUBLICATIONS

Office Action received in Taiwanese Patent Application No. 103127685 dated Mar. 9, 2016, 7 pages.
(Continued)

*Primary Examiner* — Tho G Phan
(74) *Attorney, Agent, or Firm* — Haynes and Boone, LLP

(57) ABSTRACT

A method of manufacturing an antenna is provided. The method includes steps of providing a substrate including a feed-in terminal and a ground terminal; and forming a ground conductor structure on the substrate extended from the feed-in terminal to the ground terminal and including a first conductor extended along a first direction, a second conductor extended from the first conductor along a second direction, a third conductor extended from the second conductor along a third direction, and a fourth conductor extended from the third conductor along a fourth direction, wherein a first obtuse angle is formed between the first direction and the second direction, a second obtuse angle is formed between the second direction and the third direction, and an acute angle is formed between the third direction and the fourth direction.

17 Claims, 9 Drawing Sheets

(51) Int. Cl.

| | |
|---|---|
| ***H01Q 1/48*** | (2006.01) |
| ***H01Q 9/42*** | (2006.01) |
| ***H01Q 5/371*** | (2015.01) |
| ***H01Q 5/378*** | (2015.01) |

(58) Field of Classification Search
USPC ..... 343/700 MS, 829, 846, 848
See application file for complete search history.

(56) References Cited

U.S. PATENT DOCUMENTS

| | | | | |
|---|---|---|---|---|
| 7,956,811 | B2 * | 6/2011 | Huang | H01Q 9/0421 343/700 MS |
| 9,306,285 | B2 * | 4/2016 | Huang | H01Q 1/243 |
| 2008/0106470 | A1 * | 5/2008 | Hu | H01Q 1/38 343/700 MS |
| 2012/0081261 | A1 | 4/2012 | Huang et al. | |

FOREIGN PATENT DOCUMENTS

| | | | |
|---|---|---|---|
| TW | 201019529 | A | 5/2010 |
| TW | 201119142 | A | 6/2011 |
| TW | 201411944 | A | 3/2014 |
| TW | M478253 | U | 5/2014 |

OTHER PUBLICATIONS

European Search Report received in European Patent Application No. 15174298.8, dated Dec. 21, 2015, 8 pages.

* cited by examiner

ANTENNA AND THE MANUFACTURING METHOD THEREOF

CROSS-REFERENCE TO RELATED APPLICATION AND CLAIM OF PRIORITY

The application claims the benefit of the Taiwan Patent Application No. 103127685 filed on Aug. 12, 2014 in the Taiwan Intellectual Property Office, the disclosure of which is incorporated herein in its entirety by reference.

FIELD OF THE INVENTION

The present invention relates to an antenna and the manufacturing method thereof, and more particularly to a printed single-frequency antenna and the manufacturing method thereof.

BACKGROUND OF THE INVENTION

Nowadays, various compact antennas have been developed and applied to various compact hand-held electronic devices (e.g. cellphones or notebook computers) or the wireless transmission device (e.g. the AP). For example, the planar inverse-F antenna (PIFA) or the monopole antenna that is compact, has a good transmitting efficiency, and can be easily disposed on the inner wall of the hand-held electronic device already exists, and is widely applied to various hand-held electronic devices, the notebook computer or the wireless communicating device for wireless communication.

In order to overcome the drawbacks in the prior art, an antenna and the manufacturing method thereof are provided. The particular design in the present invention not only solves the problems described above, but also is easy to be implemented. Thus, the present invention has the utility for the industry.

SUMMARY OF THE INVENTION

In accordance with an aspect of the present invention, a method of manufacturing an antenna is provided. The method includes steps of providing a substrate including a feed-in terminal and a ground terminal; and forming a ground conductor structure on the substrate extended from the feed-in terminal to the ground terminal and including a first conductor extended along a first direction, a second conductor extended from the first conductor along a second direction, a third conductor extended from the second conductor along a third direction, and a fourth conductor extended from the third conductor along a fourth direction, wherein a first obtuse angle is formed between the first direction and the second direction, a second obtuse angle is formed between the second direction and the third direction, and an acute angle is formed between the third direction and the fourth direction.

In accordance with another aspect of the present invention, an antenna is provided. The antenna includes a ground portion; a radiating portion, including a feed-in terminal; and a T-shaped resonant conductor structure extended from the ground portion; and a ground conductor structure, including a first turning point, a second turning point, a third turning point and a fourth turning point; a first conductor extended from the first turning point along a first direction; a second conductor extended from the second turning point to the third turning point along a second direction and including a taper surface, wherein the taper surface includes a first side centered with the second turning point and having a first width, a second side centered with the third turning point and having a second width, and a first length extended from the second turning point to the third turning point to cause an operating frequency band of the antenna to have a predetermined bandwidth, wherein the first width is a minimum width of the taper surface, and the second width is a maximum width of the taper surface; a third conductor extended from the third turning point to the fourth turning point along a third direction, wherein the third direction is identical to the first direction; and a fourth conductor extended from the fourth turning point to the ground portion along a fourth direction, wherein the third direction is perpendicular to the fourth direction, a first obtuse angle is formed between the first direction and the second direction, a second obtuse angle is formed between the second direction and the third direction, and an acute angle is formed between the third direction and the fourth direction.

In accordance with a further aspect of the present invention, an antenna is provided. The antenna includes a first radiating element having a feed-in terminal; a second radiating element extended from the first radiating element along a direction; and a third radiating element extended along the direction, wherein a gap is formed between the second radiating element and the third radiating element.

In accordance with further another aspect of the present invention, an antenna is provided. The antenna includes a substrate; a frequency band determining radiating element disposed on the substrate and having an extending direction; and a frequency band adjusting radiating element disposed on the substrate, extended along the extending direction, and is insulated from the frequency band determining radiating element.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1A:
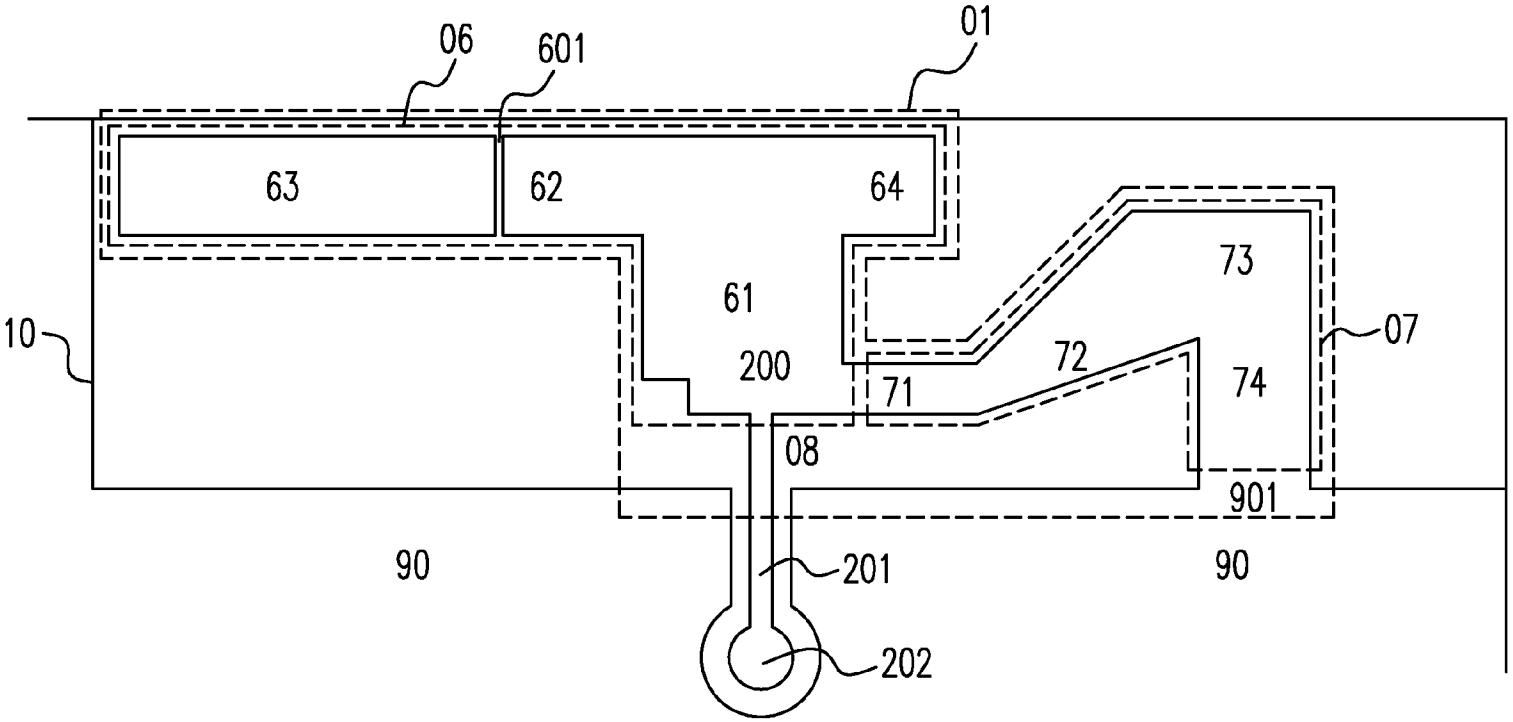
FIGS. 1A-1C show an antenna according to an embodiment of the present invention.
Figure 1B:
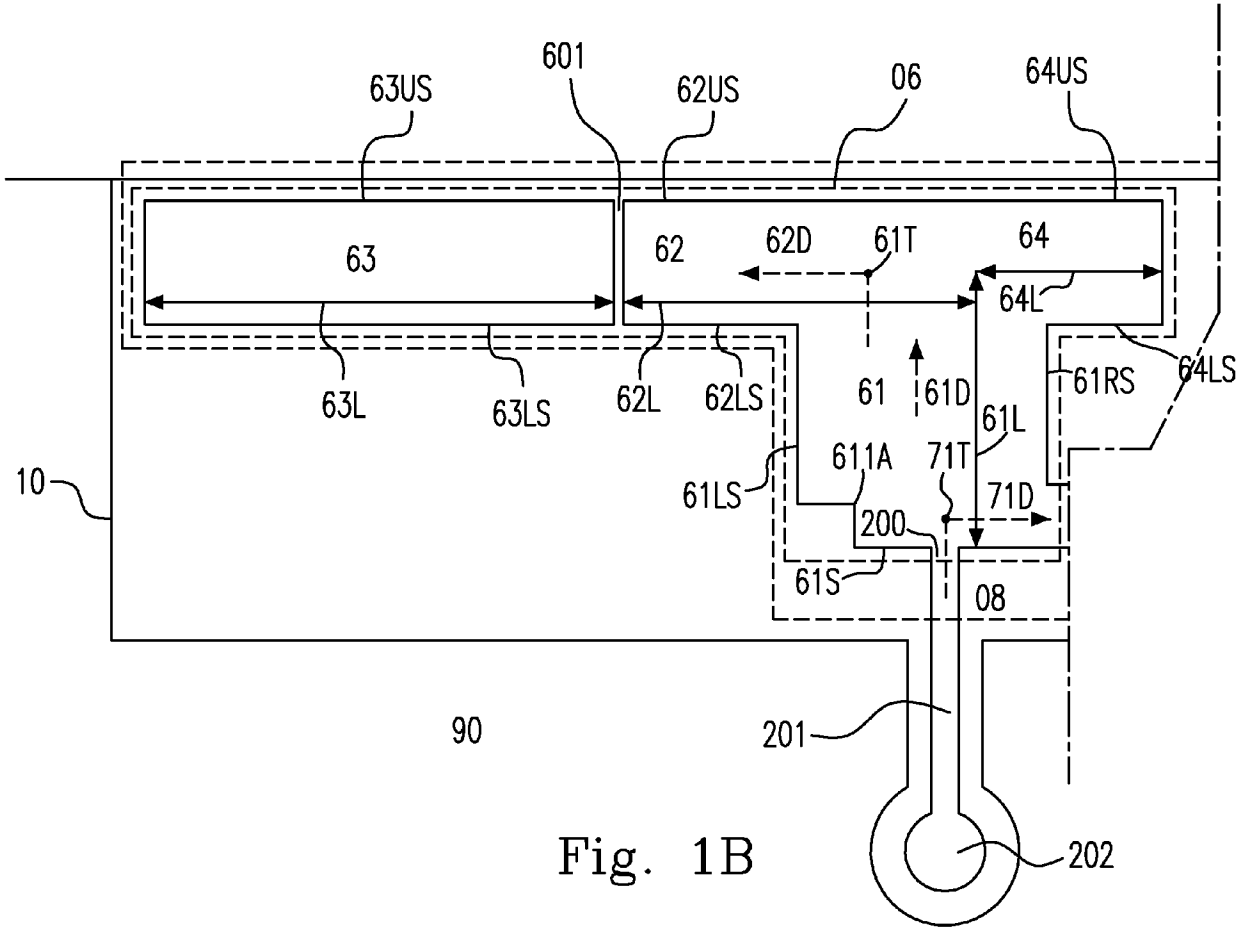
Figure 1C:
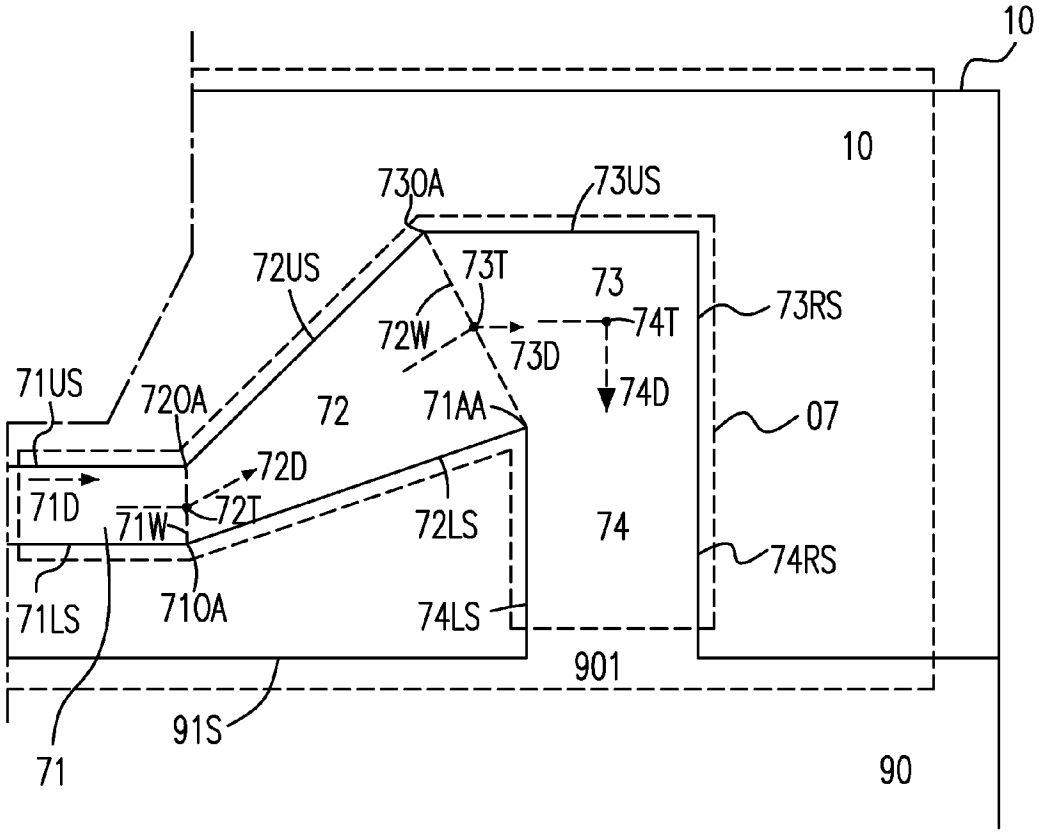
Figure 1D:
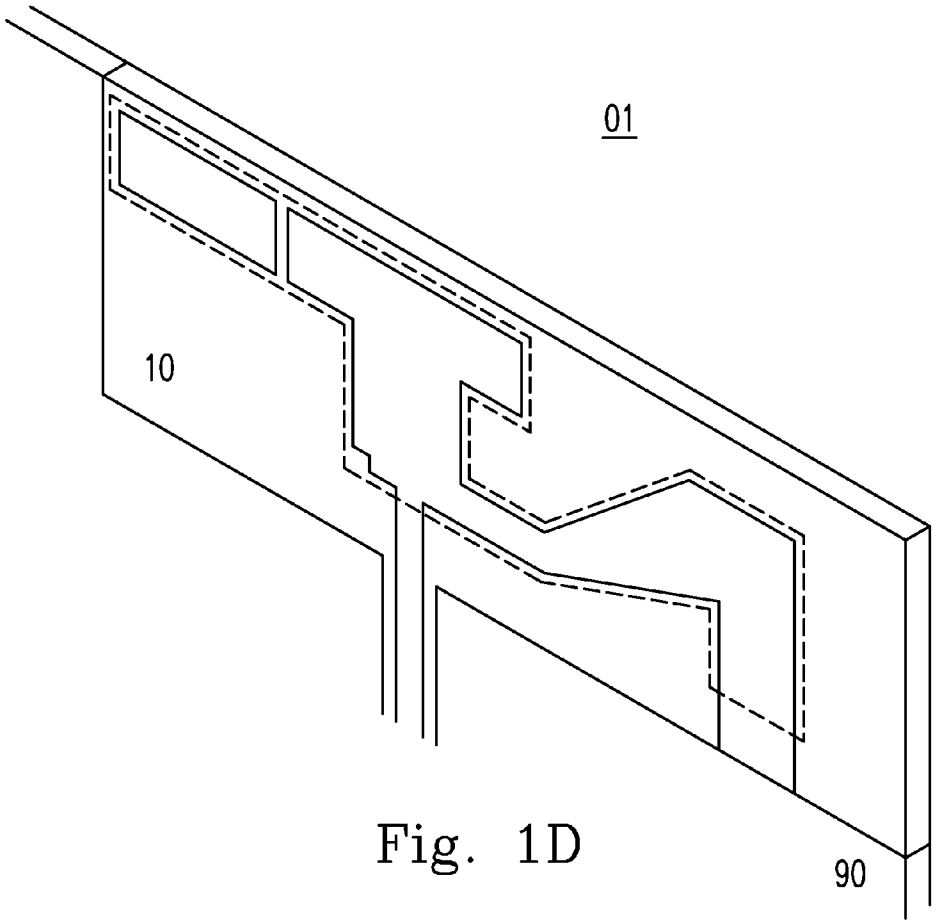
FIG. 1D is a three-dimensional diagram of the antenna in FIGS. 1A-1C.

Please refer to FIGS. 1A-1D. FIGS. 1A-1C show an antenna 01 according to an embodiment of the present invention, and FIG. 1D is a three-dimensional diagram of the antenna 01 in FIGS. 1A-1C. The antenna 01 includes a feed-in terminal 200, a radiating portion 06 and a ground portion 07. The radiating portion 06 includes a first radiating element 61, a second radiating element 62, a third radiating element 63 and a fourth radiating element 64. According to an embodiment of the present invention, the antenna 01 is a metal conductor structure manufactured on the upper edge of a printed circuit board. The ground portion 07 is extended from the feed-in terminal 200. The ground portion 07 includes a first conductor 71, a second conductor 72, a third conductor 73 and a fourth conductor 74. The first conductor 71 is extended from a first turning point 71T in the middle portion of the first radiating element 61 along a first direction 71D. The second conductor 72 is extended from a second turning point 72T along a second direction 72D. The third conductor 73 is extended from a third turning point 73T along a third direction 73D. The fourth conductor 74 is extended from a fourth turning point 74T along a fourth direction 74D, and electrically connected to a ground area 90 via a ground terminal 901.

There are a first obtuse angle 719A and a second obtuse angle 720A between the first conductor 71 and the second conductor 72. There are a third obtuse angle 730A and a first acute angle 71AA between the second conductor 72 and the third conductor 73. The first obtuse angle 710A is larger than the second obtuse angle 720A.

The second conductor 72 includes a taper surface. The taper surface has a first width 71W at the joint of the first conductor 71 and the second conductor 72, and a second width 72W at the joint of the second conductor 72 and the third conductor 73. The second width 72W is larger than the first width 71W.

A first edge 71LS at the lower side of the first conductor 71 is parallel to a second edge 71US at the upper side thereof. A third edge 72LS at the lower side of the second conductor 72 and a fourth edge 72US at the upper side thereof form the taper surface. A seventh edge 74LS at the left side of the fourth conductor 74 is parallel to an eighth edge 74RS at the right side thereof.

The first edge 71LS is parallel to a ground edge 91S at the upper side of the ground area 90.

The seventh edge 74LS at the left side of the fourth conductor 74 and the eighth edge 74RS at the right side thereof are perpendicular to the ground edge 91S at the upper side of the ground area 90.

The radiating portion 06 is a T-shaped resonant conductor. The radiating portion 06 includes a first radiating element 61, a second radiating element 62, a third radiating element 63 and a fourth radiating element 64. The first radiating element 61 is connected to the feed-in terminal 200 and the ground portion 07, and extended along a fifth direction 61D from the feed-in terminal 200. The second radiating element 62 is extended along a sixth direction 62D from a fifth turning point 61T. The third radiating element 63 is a rectangular metal conductor adjacent to and insulated from the second radiating element 62. Moreover, there is a gap 601 between the third radiating element 63 and the second radiating element 62. The radiating portion 06 further includes a fourth radiating element 64. The fourth radiating element 64 is extended from the fifth turning point 61T along a direction opposite to the sixth direction 62D.

A first re-entrant 611A is formed between a ninth edge 61S at the lower side of the first radiating element 61 and a tenth edge 61LS at the left side thereof. The tenth edge 61LS at the left side of the first radiating element 61 is parallel to an eleventh edge 61RS at the right side thereof. A twelfth edge 62LS at the lower side of the second radiating element 62 is parallel to a thirteenth edge 62US at the upper side thereof. A fourteenth edge 63LS at the lower side of the third radiating element 63 is parallel to a fifteenth edge 63US at the upper side thereof. A sixteenth edge 64LS at the lower side of the fourth radiating element 64 is parallel to a seventeenth edge 64US at the upper side thereof.

A first right angle is formed between the tenth edge 61LS at the left side of the first radiating element 61 and the twelfth edge 62LS at the lower side of the second radiating element 62. A second right angle is formed between the eleventh edge 61RS at the right side of the first radiating element 61 and the sixteenth edge 64LS at the lower side of the fourth radiating element 64.

A third right angle is formed between the second edge 73US at the upper side of the third conductor 73 and an edge 73RS at the right side thereof.

A fourth right angle is formed between the eleventh edge 61RS at the right side of the first radiating element 61 and the second edge 71US at the upper side of the first conductor 71.

The eighth edge 61S at the lower side of the first radiating element 61, the twelfth edge 62LS and the fourteenth edge 63LS at the lower side of the third radiating element 63 are all parallel to the ground edge 91S at the upper side of the ground area 90.

The eighth edge 61S at the lower side of the first radiating element 61 is connected to the first edge 71LS at the lower side of the first conductor 71.

As shown in FIGS. 1A-1D, the antenna 01 is manufactured on the printed circuit board of the electronic device. The feed-in terminal 200 of the antenna 01 is directly connected to a microstrip line conductor 201, and extended downward to an RF signal output weld on the printed circuit board. The microstrip line conductor 201 and the antenna 01 are both etched on the printed circuit board, wherein a substrate 10 is the dielectric layer of the printed circuit board.

Figure 2:
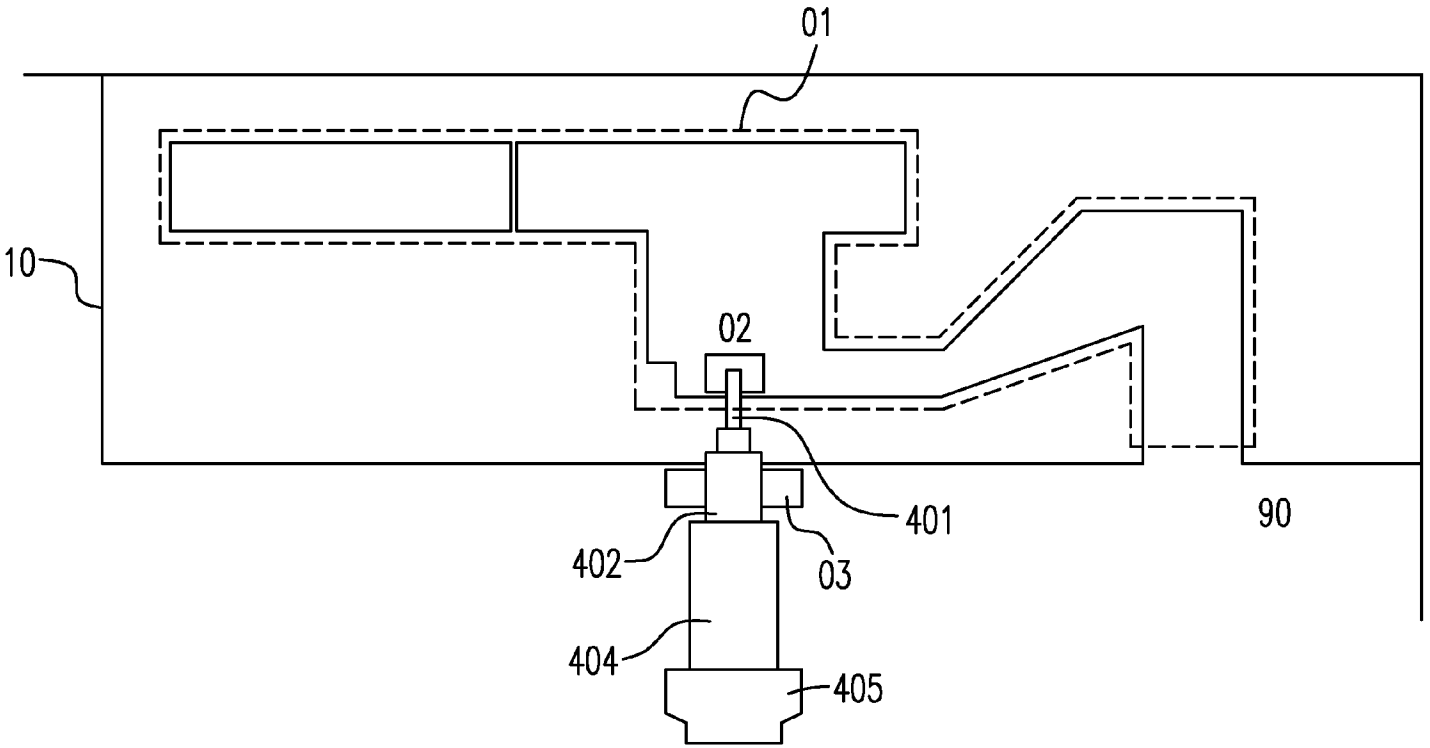
FIG. 2 shows that the antenna in FIGS. 1A-1C is connected to an RF signal via a coaxial cable.

Please refer to FIG. 2, which shows that the antenna 01 in FIGS. 1A-1C is connected to an RF signal via a coaxial cable 404. As shown in FIG. 2, the antenna 01 and the circuit of an electronic device (not shown) are manufactured on the same printed circuit board (not shown). A signal feed-in area 02 on the antenna 01 is connected to a central signal line 401 in the coaxial cable 404 having an impedance of 50Ω by welding. A signal feed-in ground area 03 of the antenna 01 is connected to a ground terminal 402 of the coaxial cable 404 by welding. Another terminal of the coaxial cable 404 is connected to an RF signal module 405 on the electronic device. The RF signal module 405 is an antenna port having a characteristic impedance of 50Ω.

In the manufacturing process of the antenna 01, usually the antenna 01 has a predetermined size according to the application requirement of the electronic device. Then, the size of a manufacturing mold is obtained by using the computer simulation according to the predetermined size, and a plurality of antenna parameters are set in the meantime. The antenna parameters include an operating frequency, an operating bandwidth and an impedance matching. The desired antenna is manufactured by the mold. The second radiating element 62 having a second length 62L is a frequency band adjusting radiating element for a first operating frequency band FB1, wherein the second length 62L can be adjusted along a direction away from or close to the fifth turning point 61T, e.g. the sixth direction 62D in FIG. 1B. The third radiating element 63 having a third length 63L is a frequency band adjusting radiating element for a second operating frequency band FB2, wherein the third length 63L can be adjusted along a direction away from or close to the second radiating element 62.

The first radiating element 61 and the second radiating element 62 constitute a frequency band determining radiating element for the first operating frequency band FB1. The first operating frequency band FB1 of the antenna 01 is set according to the fact that the sum of the second length 62L of the second radiating element 62 and the first length 61L of the first radiating element 61 is approximately a quarter of the resonance wavelength. The first radiating element 61, the second radiating element 62 and the third radiating element 63 constitute a frequency band determining radiating element for the second operating frequency band FB2. When the third radiating element 63 is electrically connected to the second radiating element 62 by welding, the second operating frequency band FB2 of the antenna 01 is set according to the fact that the sum of the length 63L of the third radiating element 63, the second length 62L of the second radiating element 62 and the first length 61L of the first radiating element 61 is approximately a quarter of the resonance wavelength. In order to meet the size of the electronic device, the first length 61L of the first radiating element 61 is usually fixed. Therefore, the second length 62L is adjusted only to obtain the first operating frequency band FB1 of the antenna 01, and the third length 63L is adjusted to obtain the second operating frequency band FB2 of the antenna 01. Subsequently, the fourth length 64L is adjusted to a proper length according to the first operating frequency band FB1 and the second operating frequency band FB2 to obtain the impedance matching between the antenna 01 and the electronic device. Then, the second width 72W is adjusted according to the selected operating frequency band and the good impedance matching to adjust the operating bandwidth of the antenna 01. For example, the sum of the length of the second radiating element 62 and the length of the first radiating element 61 is set to obtain the first operating frequency band FB1 of 5.15-5.85 GHz. When the third radiating element 63 is electrically connected to the second radiating element 62 by welding, the sum of the length of the third radiating element 63, the length of the second radiating element 62 and the length of the first radiating element 61 is set to obtain the second operating frequency band FB2 of 2.4-2.5 GHz. The first operating frequency band FB1 of the antenna 01 is 5.15-5.85 GHz, and the second operating frequency band FB2 thereof is 2.4-2.5 GHz. Through the design of the gap 601, the antenna 01 satisfying two different operating frequency bands FB1, FB2 can be manufactured on a printed circuit board, thereby saving the mold cost and time for manufacturing two antennas with two different operating frequency bands on two different printed circuit boards. Because the first width 71W is fixed and the second width 72W is larger than the first width 71W, the ratio of the second width 72W to the first width 71W is larger than 1. The operating bandwidth of the antenna 01 is changed by adjusting the second width 72W. The larger the second width 72W is, the larger the operating bandwidth of the antenna 01 is.

In addition, the operating bandwidth of the antenna 01 can be increased or reduced by fixing the third edge 72LS at the lower side of the second conductor 72 and adjusting the second obtuse angle 720A. Also, the operating bandwidth of the antenna 01 can be increased or reduced by fixing the fourth edge 72US at the upper side of the second conductor 72 and adjusting the first obtuse angle 710A, or by fixing the second edge 71US at the upper side of the first conductor 71 and adjusting the first obtuse angle 71 OA or the second obtuse angle 720A.

Figure 3:
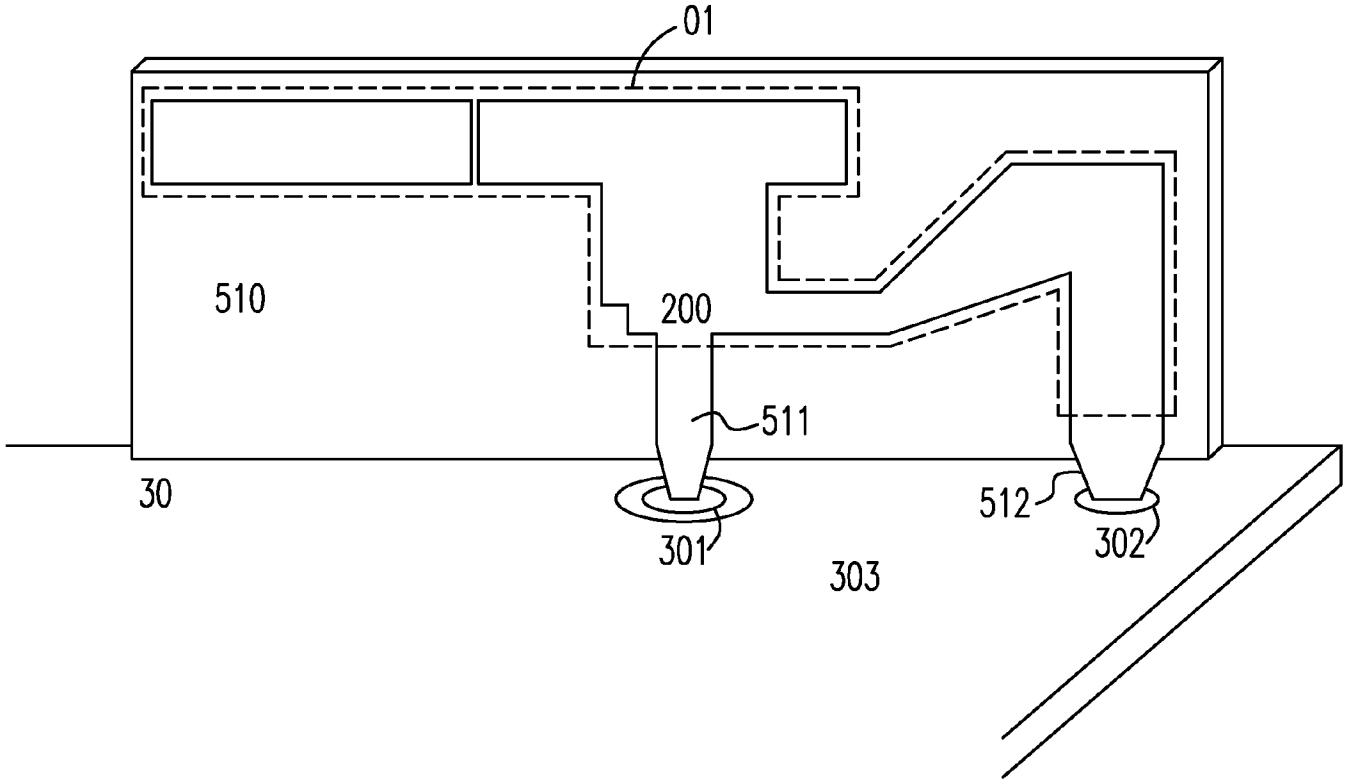
FIG. 3 shows that the antenna in FIGS. 1A-1C is manufactured on a printed circuit board and connected to another printed circuit board of an electronic device.

Please refer to FIG. 3, which shows that the antenna 01 in FIGS. 1A-1C is manufactured on a printed circuit board 510 and connected to another printed circuit board 30 of an electronic device (not shown). The antenna 01 is manufactured on the printed circuit board 510. A feed-in terminal 200 of the antenna 01 is connected to a conductive pin 511 formed at the lower edge of the printed circuit board 510. A ground terminal of the antenna 01 is connected to another conductive pin 512 formed at the lower edge of the printed circuit board 510. Accordingly, the printed circuit board 510 can be inserted into an antenna signal welding hole 391 and a metal ground welding hole 302 on the printed circuit board 30 of the electronic device, thereby causing the conductive pin 511 and the conductive pin 512 to be connected to an antenna signal (not shown) and a metal ground 303 on the printed circuit board 30 of the electronic device respectively. Therefore, the antenna 01 is a module having an antenna function, which is convenient to use and easy to assemble for an engineer unfamiliar with the antenna design.

Figure 4A:
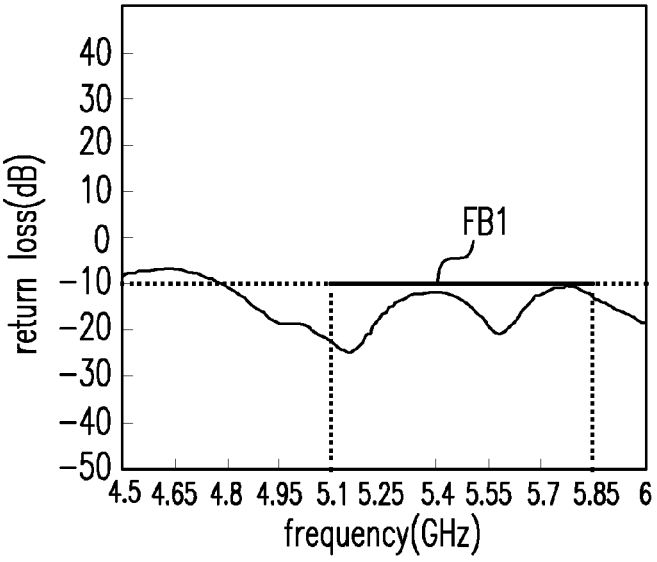
FIG. 4A shows the relationship between the return loss and the frequency when the antenna is operated in a first operating frequency band.
Figure 4B:
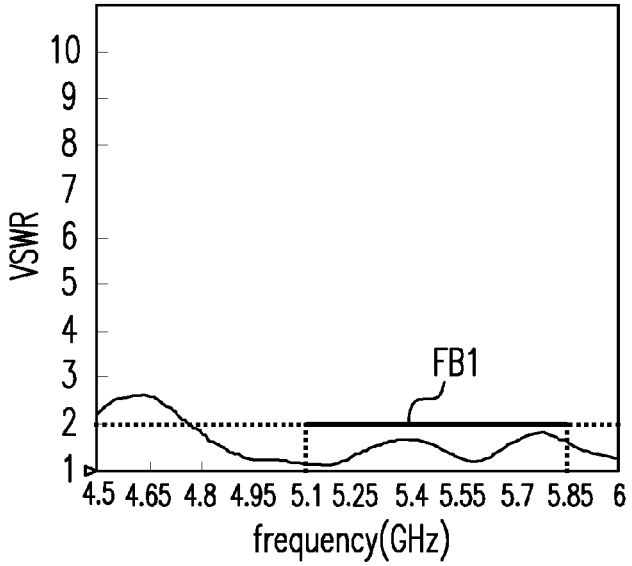
FIG. 4B shows the relationship between the voltage standing wave ratio and the frequency when the antenna is operated in the first operating frequency band.

Please refer to FIGS. 4A and 4B. FIG. 4A shows the relationship between the return loss and the frequency when the antenna 01 is operated in the first operating frequency band FB1 of 5.15-5.85 GHz. FIG. 4B shows the relationship between the voltage standing wave ratio (VSWR) and the frequency when the antenna 01 is operated in the first operating frequency band FB1 of 5.15-5.85 GHz. As shown in FIG. 4A, the return loss is reduced to below the desired maximum value "−9.5 dB". As shown in FIG. 4B, the VSWR is reduced to below the desired maximum value "2" in the first operating frequency band FB1 of 5.15-5.85 GHz, thereby obtaining the bandwidth of 1 GHz which covers the bandwidth for wireless communication under the 802.11a frequency band standard.

Figure 5A:
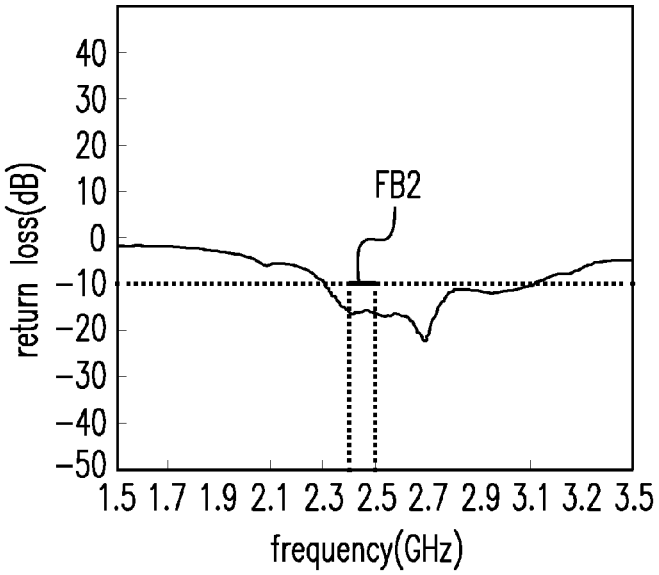
FIG. 5A shows the relationship between the return loss and the frequency when the antenna is operated in a second operating frequency band.
Figure 5B:
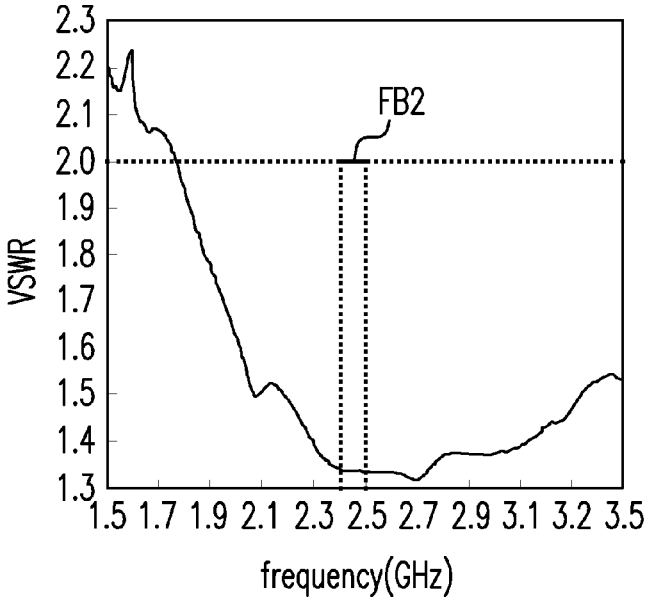
FIG. 5B shows the relationship between the voltage standing wave ratio and the frequency when the antenna is operated in the second operating frequency band.

Please refer to FIGS. 5A and 5B. FIG. 5A shows the relationship between the return loss and the frequency when the antenna 01 is operated in the second operating frequency band FB2 of 2.4-2.5 GHz. FIG. 5B shows the relationship between the voltage standing wave ratio and the frequency when the antenna 01 is operated in the second operating frequency band FB2 of 2.4-2.5 GHz. As shown in FIG. 5A, the return loss is reduced to below the desired maximum value "−9.5 dB". As shown in FIG. 5B, the VSWR is reduced to below the desired maximum value "2" in the second operating frequency band FB2 of 2.4-2.5 GHz, thereby obtaining the bandwidth of 500 MHz which covers the bandwidth for wireless communication under the 802.11b/g/n frequency band standard.

Figure 6:
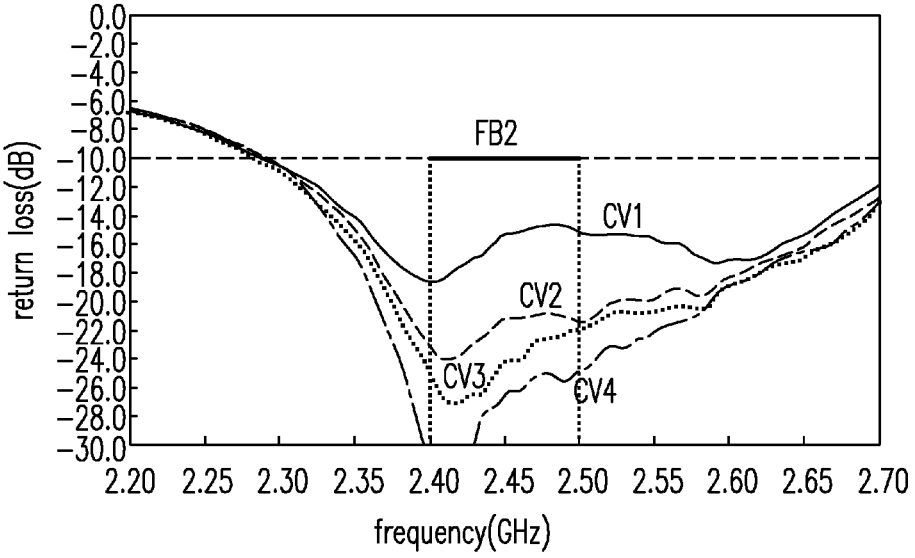
FIG. 6 shows the relationship between the return loss and the frequency, with different ratios of the second width to the first width, when the antenna is operated in the second operating frequency band.

Please refer to FIG. 6, which shows the relationship between the return loss and the frequency, with different ratios of the second width 72W to the first width 71W, when the antenna 01 is operated in the second operating frequency band FB2. As shown in FIG. 6, when the antenna 01 is set in the second operating frequency band FB2, CV1 is the return loss curve corresponding to the ratio of the second width 72W to the first width 71W being 1.61, CV2 is the return loss curve corresponding to the ratio of the second width 72W to the first width 71W being 1.9, CV3 is the return loss curve corresponding to the ratio of the second width 72W to the first width 71W being 1.96, and CV4 is the return loss curve corresponding to the ratio of the second width 72W to the first width 71W being 2.38. It can be seen from FIG. 6 that the larger the ratio of the second width 72W to the first width 71W is, the smaller the return loss is. The minimum return loss for CV1 is below −18 dB, the minimum return loss for CV2 is below −24 dB, the minimum return loss for CV3 is below −27.6 dB, and the minimum return loss for CV4 is below −30 dB. This shows that the larger the operating bandwidth of the antenna 01 is, the better the impedance matching is.

Embodiments

1. A method of manufacturing an antenna, comprising steps of providing a substrate including a feed-in terminal and a ground terminal; and forming a ground conductor structure on the substrate extended from the feed-in terminal to the ground terminal and including a first conductor extended along a first direction, a second conductor extended from the first conductor along a second direction, a third conductor extended from the second conductor along a third direction, and a fourth conductor extended from the third conductor along a fourth direction, wherein a first obtuse angle is formed between the first direction and the second direction, a second obtuse angle is formed between the second direction and the third direction, and an acute angle is formed between the third direction and the fourth direction.

2. The method of Embodiment 1, further comprising a step of forming a first radiating element, a second radiating element and a third radiating element on the substrate, wherein the substrate has a first turning point; and the first radiating element is extended from the feed-in terminal to the first turning point and has a first length, the second radiating element is extended from the first turning point and has a second length, and the third radiating element is adjacent to the second radiating element and has a third length.

3. The method of any one of Embodiments 1-2, wherein the second radiating element is a first rectangular conductor; and the third radiating element is a second rectangular conductor.

4. The method of any one of Embodiments 1-3, wherein when the second radiating element is insulated from the third radiating element, the antenna is operated in a first frequency band.

5. The method of any one of Embodiments 1-4, wherein when the second radiating element is electrically connected to the third radiating element, the antenna is operated in a second frequency band.

6. The method of any one of Embodiments 1-5, wherein the sum of the first length and the second length is a quarter of a first wavelength of the first frequency band.

7. The method of any one of Embodiments 1-6, wherein the sum of the first length, the second length and the third length is a quarter of a second wavelength of the second frequency band.

8. The method of any one of Embodiments 1-7, further comprising a step of adjusting the second length to change a first resonant frequency of the first frequency band.

9. The method of any one of Embodiments 1-8, further comprising steps of adjusting one of the second length and the third length to change a second resonant frequency of the second frequency band; and adjusting the acute angle, the first obtuse angle and the second obtuse angle to change one of a first bandwidth of the first frequency band and a second bandwidth of the second frequency band.

10. The method of any one of Embodiments 1-9, further comprising a step of forming a fourth radiating element on the substrate, wherein the fourth radiating element is extended from the second radiating element.

11. The method of any one of Embodiments 1-10, wherein the extending direction of the fourth radiating element is opposite to the extending direction of the second radiating element.

12. The method of any one of Embodiments 1-11, wherein the fourth radiating element is a rectangular conductor.

13. The method of any one of Embodiments 1-12, wherein the rectangular conductor has a fourth length, the method further comprising a step of adjusting the fourth length to match the impedance of the antenna.

14. An antenna, comprising a ground portion; a radiating portion, including a feed-in terminal; and a T-shaped resonant conductor structure extended from the ground portion; and a ground conductor structure, including a first turning point, a second turning point, a third turning point and a fourth turning point; a first conductor extended from the first turning point along a first direction; a second conductor extended from the second turning point to the third turning point along a second direction and including a taper surface, wherein the taper surface includes a first side centered with the second turning point and having a first width, a second side centered with the third turning point and having a second width, and a first length extended from the second turning point to the third turning point to cause an operating frequency band of the antenna to have a predetermined bandwidth, wherein the first width is a minimum width of the taper surface, and the second width is a maximum width of the taper surface; a third conductor extended from the third turning point to the fourth turning point along a third direction, wherein the third direction is identical to the first direction; and a fourth conductor extended from the fourth turning point to the ground portion along a fourth direction, wherein the third direction is perpendicular to the fourth direction, a first obtuse angle is formed between the first direction and the second direction, a second obtuse angle is formed between the second direction and the third direction, and an acute angle is formed between the third direction and the fourth direction.

15. The antenna of Embodiment 14, wherein the first conductor includes a first edge and a second edge parallel to the first edge; the second conductor includes a third edge extended from the first edge and a fourth edge extended from the second edge; the third conductor includes a fifth edge extended from the fourth edge; the fifth edge is parallel to the second edge; a third obtuse angle is formed between the first edge and the third edge; a fourth obtuse angle is formed between the second edge and the fourth edge, wherein the third obtuse angle is larger than the fourth obtuse angle; and a fifth obtuse angle is formed between the fourth edge and the fifth edge.

16. The antenna of any one of Embodiments 14-15, further comprising a substrate, wherein the ground portion and the radiating portion are disposed on the substrate; the T-shaped resonant conductor structure includes a fifth turning point; a first radiating element connected to the feed-in terminal and the ground conductor structure, and extended along a fifth direction; and a second radiating element extended from the first radiating element along a sixth direction, wherein the sixth direction is perpendicular to the fifth direction; and the operating frequency band of the antenna depends on the length of the second radiating element.

17. The antenna of any one of Embodiments 14-16, wherein the T-shaped resonant structure further includes a fourth radiating element; the fourth radiating element is extended along a seventh direction opposite to the sixth direction; the fourth radiating element is a rectangular conductor having a fourth length; and an impedance matching of the antenna depends on the fourth length.

18. An antenna, comprising a first radiating element having a feed-in terminal; a second radiating element extended from the first radiating element along a direction; and a third radiating element extended along the direction, wherein a gap is formed between the second radiating element and the third radiating element.

19. The antenna of Embodiment 18, further comprising a conductive medium filled into the gap to conduct the second radiating element and the third radiating element.

20. An antenna, comprising a substrate; a frequency band determining radiating element disposed on the substrate and having an extending direction; and a frequency band adjusting radiating element disposed on the substrate, extended along the extending direction, and is insulated from the frequency band determining radiating element.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A method of manufacturing an antenna, comprising steps of:

providing a substrate including a feed-in terminal and a ground terminal; and forming a ground conductor structure on the substrate extended from the feed-in terminal to the ground terminal and including a first conductor extended along a first direction, a second conductor extended from the first conductor along a second direction and having a taper surface, a third conductor extended from the second conductor along a third direction, and a fourth conductor extended from the third conductor along a fourth direction and electrically connected to the ground terminal, wherein:

a first obtuse angle is formed between the first direction and the second direction, a second obtuse angle is formed between the second direction and the third direction, and an acute angle is formed between the third direction and the fourth direction, and the taper surface has a first width at a first joint of the first and the second conductors and a second width at a second joint of the second and the third conductors, and the second width is larger than the first width.

2. The method as claimed in claim 1, further comprising a step of: forming a first radiating element, a second radiating element and a third radiating element on the substrate, wherein:

the substrate has a first turning point; and the first radiating element is extended from the feed-in terminal to the first turning point and has a first length, the second radiating element is extended from the first turning point and has a second length, and the third radiating element is adjacent to the second radiating element and has a third length.

3. The method as claimed in claim 2, wherein:

the second radiating element is a first rectangular conductor; and the third radiating element is a second rectangular conductor.

4. The method as claimed in claim 3, wherein when the second radiating element is insulated from the third radiating element, the antenna is operated in a first frequency band.

5. The method as claimed in claim 4, wherein when the second radiating element is electrically connected to the third radiating element, the antenna is operated in a second frequency band.

6. The method as claimed in claim 5, wherein the sum of the first length and the second length is a quarter of a first wavelength of the first frequency band.

7. The method as claimed in claim 6, wherein the sum of the first length, the second length and the third length is a quarter of a second wavelength of the second frequency band.

8. The method as claimed in claim 7, further comprising a step of adjusting the second length to change a first resonant frequency of the first frequency band.

9. The method as claimed in claim 8, further comprising steps of:

adjusting one of the second length and the third length to change a second resonant frequency of the second frequency band; and adjusting the acute angle, the first obtuse angle and the second obtuse angle to change one of a first bandwidth of the first frequency band and a second bandwidth of the second frequency band.

10. The method as claimed in claim 1, further comprising a step of forming a fourth radiating element on the substrate, wherein the fourth radiating element is extended from the second radiating element.

11. The method as claimed in claim 10, wherein the extending direction of the fourth radiating element is opposite to the extending direction of the second radiating element.

12. The method as claimed in claim 11, wherein the fourth radiating element is a rectangular conductor.

13. The method as claimed in claim 12, wherein the rectangular conductor has a fourth length, the method further comprising a step of adjusting the fourth length to match the impedance of the antenna.

14. An antenna, comprising:

a ground portion having a ground terminal;

a radiating portion, including:

a feed-in terminal; and a T-shaped resonant conductor structure extended from the ground portion; and a ground conductor structure, including:

a first turning point, a second turning point, a third turning point and a fourth turning point;

a first conductor extended from the first turning point along a first direction;

a second conductor extended from the second turning point to the third turning point along a second direction and including a taper surface, wherein the taper surface includes a first side centered with the second turning point and has a first width, a second side centered with the third turning point having has a second width, and a first length extended from the second turning point to the third turning point to cause an operating frequency band of the antenna to have a predetermined bandwidth, wherein the first width is a minimum width of the taper surface, and the second width is a maximum width of the taper surface;

a third conductor extended from the third turning point to the fourth turning point along a third direction, wherein the third direction is identical to the first direction; and a fourth conductor extended from the fourth turning point to the ground portion along a fourth direction, and electrically connected to the ground portion at the ground terminal, wherein the third direction is perpendicular to the fourth direction, a first obtuse angle is formed between the first direction and the second direction, a second obtuse angle is formed between the second direction and the third direction, and an acute angle is formed between the third direction and the fourth direction.

15. The antenna as claimed in claim 14, wherein:

the first conductor includes a first edge and a second edge parallel to the first edge;

the second conductor includes a third edge extended from the first edge and a fourth edge extended from the second edge;

the third conductor includes a fifth edge extended from the fourth edge;

the fifth edge is parallel to the second edge;

a third obtuse angle is formed between the first edge and the third edge;

a fourth obtuse angle is formed between the second edge and the fourth edge, wherein the third obtuse angle is larger than the fourth obtuse angle; and a fifth obtuse angle is formed between the fourth edge and the fifth edge.

16. The antenna as claimed in claim 14, further comprising a substrate, wherein:

the ground portion and the radiating portion are disposed on the substrate;

the T-shaped resonant conductor structure includes:

a fifth turning point;

a first radiating element connected to the feed-in terminal and the ground conductor structure, and extended along a fifth direction; and a second radiating element extended from the first radiating element along a sixth direction, wherein the sixth direction is perpendicular to the fifth direction; and the operating frequency band of the antenna depends on the length of the second radiating element.

17. The antenna as claimed in claim 16, wherein:

the T-shaped resonant structure further includes a fourth radiating element;

the fourth radiating element is extended along a seventh direction opposite to the sixth direction;

the fourth radiating element is a rectangular conductor having a fourth length; and an impedance matching of the antenna depends on the fourth length.

* * * * *